US010610726B2

(12) United States Patent
Yarvitz

(10) Patent No.: US 10,610,726 B2
(45) Date of Patent: Apr. 7, 2020

(54) MULTI-FUNCTIONAL EXERCISE SYSTEM WITH VARIABLE RESISTANCE

(71) Applicant: Chad M. Yarvitz, San Diego, CA (US)

(72) Inventor: Chad M. Yarvitz, San Diego, CA (US)

( * ) Notice: Subject to any disclaimer, the term of this patent is extended or adjusted under 35 U.S.C. 154(b) by 127 days.

(21) Appl. No.: 15/943,687

(22) Filed: Apr. 2, 2018

(65) Prior Publication Data

US 2019/0015697 A1 Jan. 17, 2019

Related U.S. Application Data

(60) Provisional application No. 62/532,729, filed on Jul. 14, 2017.

(51) Int. Cl.

| | |
|---|---|
| ***A63B 22/20*** | (2006.01) |
| ***A63B 21/00*** | (2006.01) |
| ***A63B 69/06*** | (2006.01) |
| ***A63B 71/02*** | (2006.01) |

(52) U.S. Cl.

CPC ..... *A63B 22/20* (2013.01); *A63B 21/4033* (2015.10); *A63B 21/4043* (2015.10); *A63B 69/06* (2013.01); *A63B 21/00058* (2013.01); *A63B 2071/025* (2013.01)

(58) Field of Classification Search

CPC . A63B 22/20; A63B 21/4043; A63B 21/4033; A63B 69/06; A63B 2071/025; A63B 21/00058

See application file for complete search history.

(56) References Cited

U.S. PATENT DOCUMENTS

| | | | | |
|---|---|---|---|---|
| 4,134,584 | A * | 1/1979 | Rosenbusch | A63B 21/0618 482/132 |
| 6,773,379 | B1 * | 8/2004 | Bing | A63B 22/20 482/132 |
| 8,827,879 | B2 * | 9/2014 | Nicholas | A63B 21/0004 482/132 |
| 9,358,419 | B1 * | 6/2016 | Smith | A63B 21/06 |
| 9,498,676 | B1 * | 11/2016 | Emick | A63B 23/04 |
| D795,365 | S * | 8/2017 | Peritz | D21/689 |
| 2007/0184951 | A1 * | 8/2007 | James | A63B 23/12 482/141 |
| 2009/0143200 | A1 * | 6/2009 | Hawkersmith | A63B 69/004 482/87 |
| 2009/0305853 | A1 * | 12/2009 | Jordan | A63B 21/0004 482/132 |
| 2010/0130337 | A1 * | 5/2010 | Stewart | A63B 22/20 482/121 |
| 2010/0267533 | A1 * | 10/2010 | Susnjara | A63B 21/0004 482/142 |

(Continued)

*Primary Examiner* — Sundhara M Ganesan

(57) ABSTRACT

Embodiments for a multi-functional exercise system with variable resistance are provided. The system includes a base plate such as an exercise plate weight, cover plates, omni-directional wheels, a protective skirt frame, and various attachment adapters. These are structured such that the top cover plate is attached to a top face of the base plate and a bottom cover plate is attached to a bottom face of the base plate, the omnidirectional wheels and protective skirt frame are attached to the bottom cover plate, and the attachment adapters are fastened to a central aperture defined by the base plate. The described embodiments allow a user to use this exemplary system to perform multiple exercises with various attachments.

19 Claims, 13 Drawing Sheets

(56) References Cited

U.S. PATENT DOCUMENTS

| | | | | |
|---|---|---|---|---|
| 2010/0317496 | A1* | 12/2010 | Abranchess | A63B 21/0004 482/141 |
| 2011/0105288 | A1* | 5/2011 | Susnjara | A63B 21/0004 482/142 |
| 2011/0118088 | A1* | 5/2011 | Caya | A63B 21/0618 482/51 |
| 2013/0023391 | A1* | 1/2013 | Nicholas | A63B 21/0004 482/132 |
| 2013/0303345 | A1* | 11/2013 | Shauli | A63B 21/045 482/127 |
| 2015/0011369 | A1* | 1/2015 | Peritz | A63B 26/003 482/142 |
| 2015/0111705 | A1* | 4/2015 | Walker | A63B 26/00 482/66 |
| 2015/0209612 | A1* | 7/2015 | Shen | A63B 21/068 482/147 |
| 2016/0089576 | A1* | 3/2016 | Rosenstiel | A63B 26/003 482/146 |
| 2016/0220862 | A1* | 8/2016 | Johnson | A63B 22/20 |
| 2016/0228737 | A1* | 8/2016 | Rahnasto | A63B 21/0618 |
| 2016/0279466 | A1* | 9/2016 | Smith | A63B 22/20 |
| 2016/0287932 | A1* | 10/2016 | Brown | A63B 21/068 |
| 2017/0354839 | A1* | 12/2017 | Reque | A63B 21/4035 |
| 2018/0036588 | A1* | 2/2018 | Brown | A63B 21/0004 |
| 2018/0050232 | A1* | 2/2018 | Bahrami | A63B 22/20 |

* cited by examiner

MULTI-FUNCTIONAL EXERCISE SYSTEM WITH VARIABLE RESISTANCE

CROSS-REFERENCE TO RELATED APPLICATIONS

This application claims priority to U.S. Provisional Application No. 62/532,729, filed on Jul. 14, 2017. The content of the above application is hereby expressly incorporated by reference herein in its entirety.

FIELD OF THE DISCLOSURE

This disclosure relates generally to the field of exercise equipment. More specifically, this disclosure relates to a multi-functional exercise system with variable resistance.

BACKGROUND

Currently there are a number of solutions for full body exercises using wheeled platform devices. Some of these solutions attempt to use circular, wheeled platforms for multi-directional exercise using multiple platforms for different body parts. Some other solutions include attaching resistance bands, anchored to doors, walls, or other immovable objects, around wheeled platforms to create resistance for training. Some solutions also have attachments that facilitate ground exercises in which a user can execute exercises in non-standing positions.

SUMMARY

The disclosure presented herein relates to a multi-functional exercise system with variable resistance. In one, non-limiting embodiment, the system includes a base plate having a top face and a bottom face, with the base plate defining a central aperture that extends through the top face and the bottom face. The system also includes at least one cover plate, with the at least one cover plate having a flat disk shape, a plurality of omnidirectional wheels, a protective skirt frame, a plurality of attachments, and an attachment adapter base configured to receive at least one of the plurality of attachments. Further, the at least one cover plate includes a bottom cover plate coupled to the bottom face of the base plate.

In one, non-limiting embodiment, the system includes a base plate comprising a top plate and a bottom plate, with the top plate attached to the bottom plate, with the base plate defining a unified central aperture that extends through the top plate and the bottom plate. The system also includes a plurality of omnidirectional wheels, a protective skirt frame, a plurality of attachments, and an attachment adapter base configured to receive at least one of the plurality of attachments.

Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range having a lower limit and an upper limit corresponding to the first number and the second number, respectively. For example, 25 to 100 mm means a range whose lower limit is 25 mm and upper limit is 100 mm. Further details regarding various embodiments for one or more exemplary multi-functional exercise devices and systems are provided below with respect to the Figures.

Figure 1:
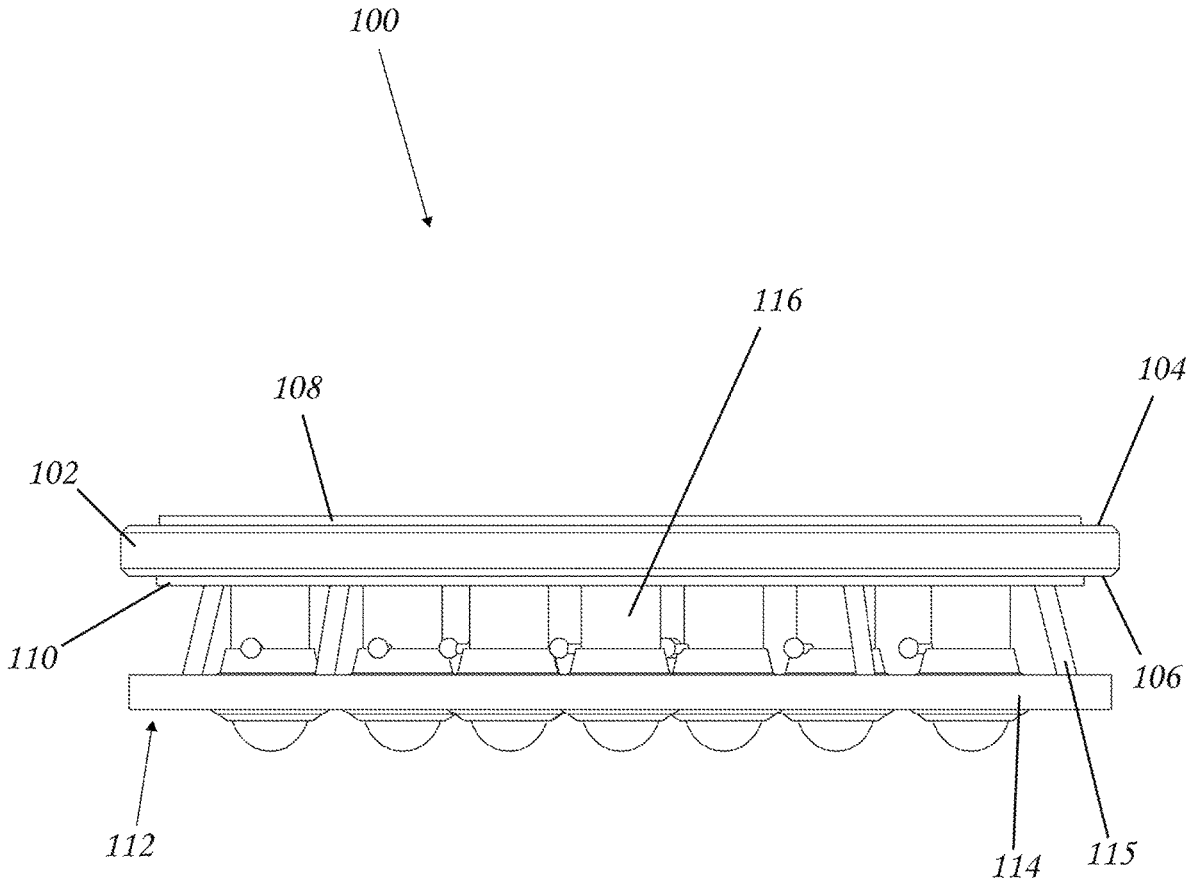
FIG. 1 is a side elevation view depicting a multi-functional exercise system according to one embodiment.
Figure 2:
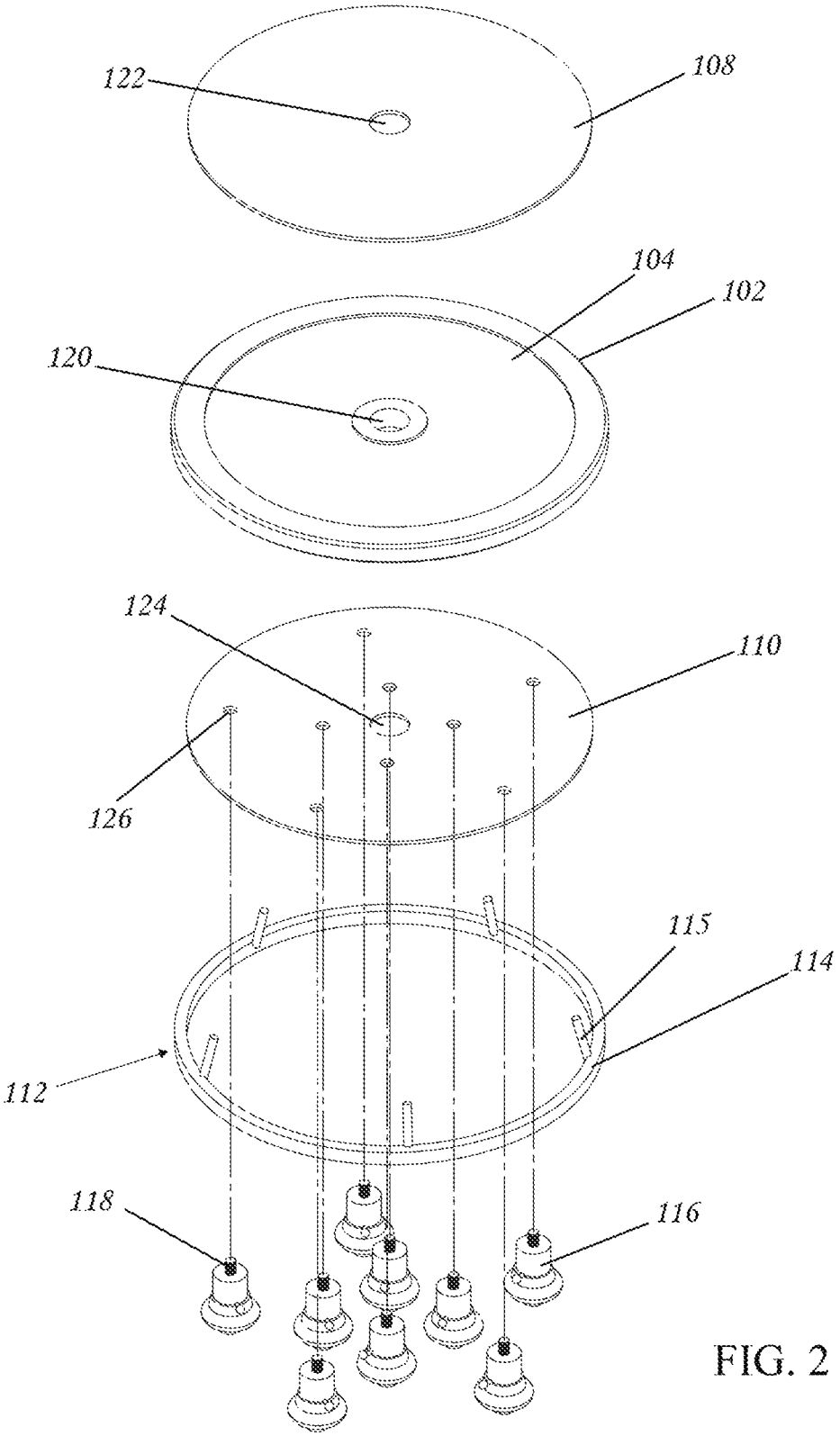
FIG. 2 is an exploded perspective view depicting the system of FIG. 1.
Figure 3:
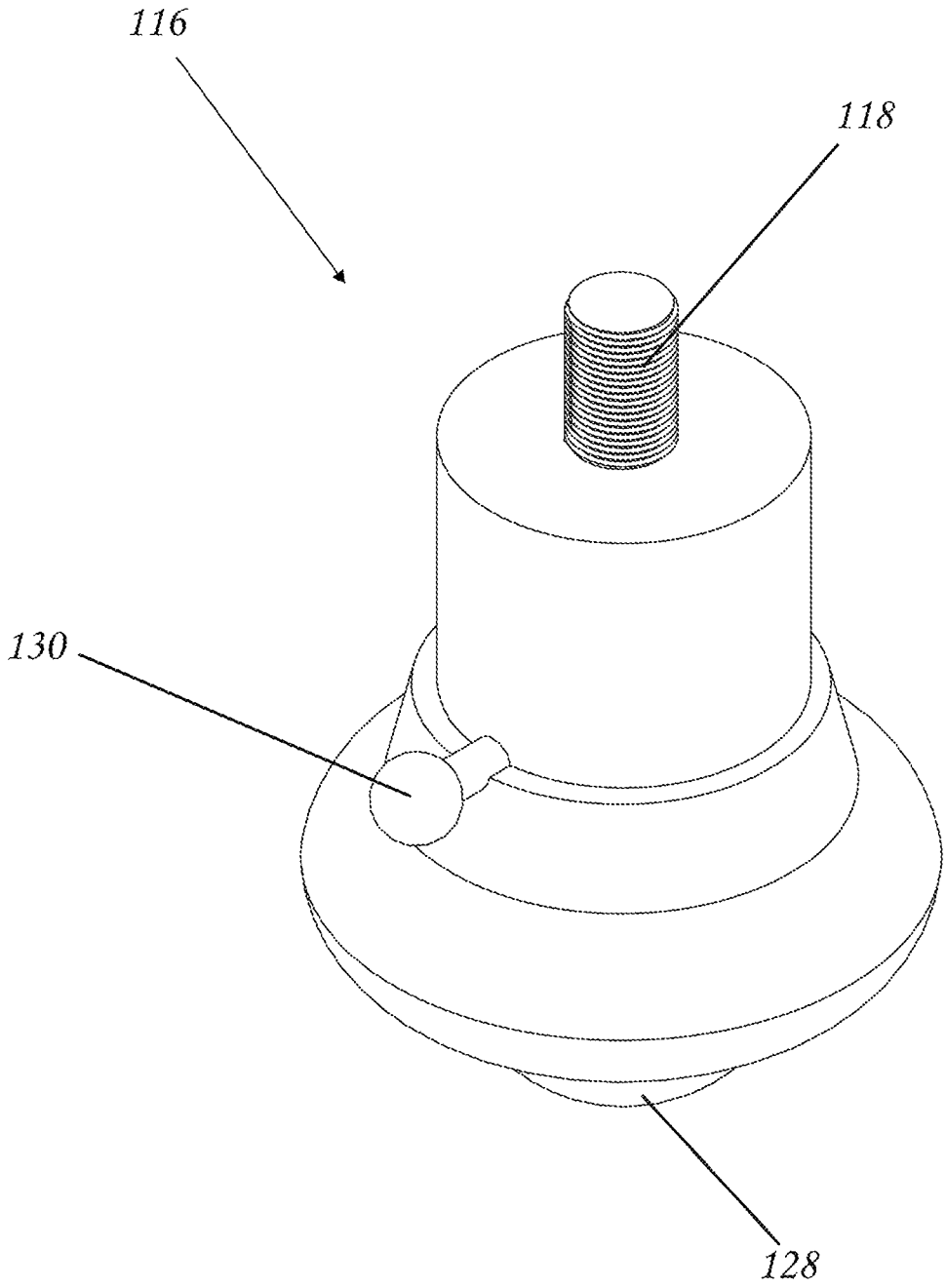
FIG. 3 is a perspective view depicting an omnidirectional caster wheel of the system of FIG. 1.

Turning to FIGS. 1-3, FIGS. 1-3 depict a multi-functional exercise system 100. System 100 is an exemplary system and embodiments may include some or all of the components depicted in these Figures, as well as other components not shown. FIG. 1 shows the components of system 100, according to a non-limiting embodiment, as assembled together. FIG. 2 shows an exploded view of the various components pictured in FIG. 1 and provides an indication of how these components may be assembled together, according to a non-limiting embodiment.

In a non-limiting embodiment, the system 100 can include a base plate 102 defining a central aperture (not shown). The base plate 102 may be a standard exercise plate such as ones commonly found most exercise gyms. These weights generally come with a predetermined weight similar to dumbbell weights. As used herein, standard exercise plates are each assigned a predetermined weight, for instance, of 45 lbs. 35 lbs., and 25 lbs. These weights are generally stacked or fastened to a steel bar and lifted for cardiovascular and weightlifting exercises. Further, standard exercise plates are often made of composite rubber or metal, which are both standard in the exercise industry. Because the system 100 can accommodate standard exercise plates, the system can be used in virtually any exercise gym setting to accommodate virtually all standard exercise plates or exercise weights.

Alternatively, the base plate 102 can be any flat disk with a predetermined weight that is not a standard exercise plate. In such an embodiment, the base plate 102 would preferably still define a central aperture 120 and be shaped and sized similar to a standard exercise plate weight. The flat disk shape of the base plate 102 allows a user to stack additional weights or standard exercise plates on top of the system 100 to increase resistance for various exercises, such as pulling and pushing the system 100 on the ground. The flat disk shape also allows a user to stand on top of the base plate 102, or stack various objects to facilitate jumping exercises wherein a user jumps onto or over the base plate 102 and any objects stacked on top. Still in other embodiments, base plate 102 can have alternative shapes and dimensions to accommodate a variety of body sizes or increased weight. The base plate 102 can have a top face 104 and a bottom face 106. The system 100 can include a top cover plate 108 covering the top face 104 of the base plate 102 and a bottom cover plate 110 covering the bottom face 106 of the base plate 102. In some embodiments, the base plate 102 may omit the cover plates. The top cover plate 108 and bottom cover plate 110, in one embodiment, can be attached to the top face 104 and bottom face 106, respectively, of the base plate 102 by welding or similar methods (or any other means of attachment as known in the art). In other embodiments, the top cover plate 108 may be fastened to the top face 104 of the base plate 102 and the bottom cover plate 110 may be attached to the bottom face 106 of the base plate 102.

As shown in FIGS. 1-2, the system 100 can also include a protective skirt frame 112, which can be attached to the bottom cover plate 110. In one embodiment, protective skirt frame 112 may be adapted in size to match that of a perimeter of the base plate 102. The skirt frame 112 can be made from metal such as stainless steel and iron, hard plastic, or any other suitable material as known in the art. The skirt frame 112 may be attached to the bottom cover plate 110 by welding or similar methods or any means of attachment known in the art, including via fasteners or adhesives.

The skirt frame 112 can include a ring 114 that is similarly shaped and sized as the base plate 102. Further, the skirt frame 112 can have connecting members 115 that are circumferentially spaced on the ring 114 and extend vertically from the ring. The connecting members 115 can be attached to the bottom cover plate 110 by welding or similar methods, such that the connecting members 115 may assist in fixing the skirt frame 112 to the bottom cover plate 110. The number of connecting members 115 shown in FIGS. 1-2 are non-limiting, and one of ordinary skill in the art will appreciate that more or less connecting members 115 may alternatively be used.

In other embodiments, the skirt frame 112 may be removably fastened to the bottom cover plate 110 using removeable fasteners to easily remove the skirt frame 112 as needed. In other embodiments, the skirt frame 112 may be a mesh screen collar or a wall collar. In addition to the above, system 100 can also include a plurality of omnidirectional caster wheels ("caster wheels") 116 which can be attached to the bottom cover plate 110. It is noted that more or less caster wheels 116 as shown in FIGS. 1-2 may be used in various embodiments.

Referring now to FIG. 2, top cover plate 108 may be attached to the top face 104 of the base plate 102 and the bottom cover plate 110 may be attached to the bottom face (not shown) of the base plate 102. In some embodiments, the top cover plate 108 may be fastened to the base plate 102. Further, top cover plate 108 may be manufactured having different sizes and shapes, and may be designed to accommodate different body sizes and different exercises. The top cover plate 108 may define a central aperture 122 that can have the same shape and size as the central aperture 120 defined by the base plate 102. Further, the bottom cover plate 110 may also define a central aperture 124 that can have the same shape and size of the central aperture 120 defined by the base plate 102. The cover plates 108 and 110, in one or more embodiments, may be flat circular disks which can have the same shape and diameter of the base plate 102. Alternatively, either cover plate 108 and 110 may be varied in diameter and not necessarily have the same diameters.

In some embodiments, wherein the base plate 102 is a standard exercise plate, the top cover plate 108 and bottom cover plate 110 can cover grooves and indents defined by a standard exercise plate to provide top and bottom flat surfaces. In one or more embodiments, metal eyelets (not shown) can be attached to the cover plates to accommodate additional attachments such as rope, chains, poles, bars, and handles that allow the user to perform more exercises.

The system 100 may also include a skirt frame 112 which may have a ring 114 and a plurality of connecting members 115. The connecting members 115 may be attached to the bottom cover plate 110, thereby attaching the entire skirt frame 112 to the bottom cover plate, by welding or similar methods.

Additionally, in some embodiments, the caster wheels 116 may be fastened to the bottom cover plate 110. One non-limiting method of attaching the caster wheels 116 to bottom cover plate 110 may include screwing in a bolt, such as bolt 118, which is attached to an individual caster wheel 116, into one of a plurality of small apertures 126 defined by the bottom cover plate 110. In other embodiments, the caster wheels 116 may be attached by welding or similar methods to the bottom cover plate 110. Advantageously, attaching caster wheels 116 to the bottom cover plate 110 allows the caster wheels 116 to be level to ensure smooth movement on the ground, particularly in embodiments where the base plate 102 is a standard exercise plate that has an uneven surfaces due to grooves and indents.

However, in some embodiments, the base plate 102 may be a disk with a predetermined weight with flat surfaces, and the caster wheels 116 may be attached directly to such a base plate 102 using any means of attachment known in the art. The central aperture 120 of the base plate 102 can receive different attachment coupling means (not shown) such as a swivel connector for a mop handle or a vertical column to stack additional standard exercise plate weights or weighted disks.

Referring now to FIG. 3, a perspective view of an omnidirectional caster wheel, such as caster wheel 116 as shown in FIGS. 1-2 and described above, is provided. In one or more embodiments, the caster wheels 116 can be ball-type caster wheels. Ball-type caster wheels can have a track ball 128 that can move in all directions similar to wheels attached to swivels. In some embodiments, the caster wheels 116 have a braking mechanism 130 that can be depressed or otherwise activated so as to fully stop a caster wheel 116 from rolling. In one or more embodiments, all of the caster wheels 116 may have braking mechanisms 130. A user can increase the intensity of certain exercises without adding additional weight to the system 100 by engaging the braking mechanism 130 of at least one of these caster wheels 116. Engaging the braking mechanism 130 prevents the caster wheel 116 from rolling, which creates more friction between the ground and the caster wheel 116, thereby increasing resistance and the intensity of the workout. A user can adjust the level of resistance through just the caster wheels 116 by engaging or disengaging any amount of braking mechanisms 130 on the caster wheels 116. In other embodiments, at least one of the caster wheels 116 have braking mechanisms 130. In yet another embodiment, the caster wheels 116 can omit braking mechanisms 130. In other embodiments, the caster wheels 116 may have individual adjustable braking mechanisms (not shown) such that one caster wheel 116 may have different levels of braking ranging from free rolling wherein the brakes are fully disengaged to full stop where the brakes are fully engaged. FIG. 3 further illustrates a bolt, such as bolt 118, protruding from a top surface of caster wheel 116. As previously described, in some embodiments, bolt 118 may be used to fasten caster wheel 116 to bottom cover plate 110.

Figure 4:
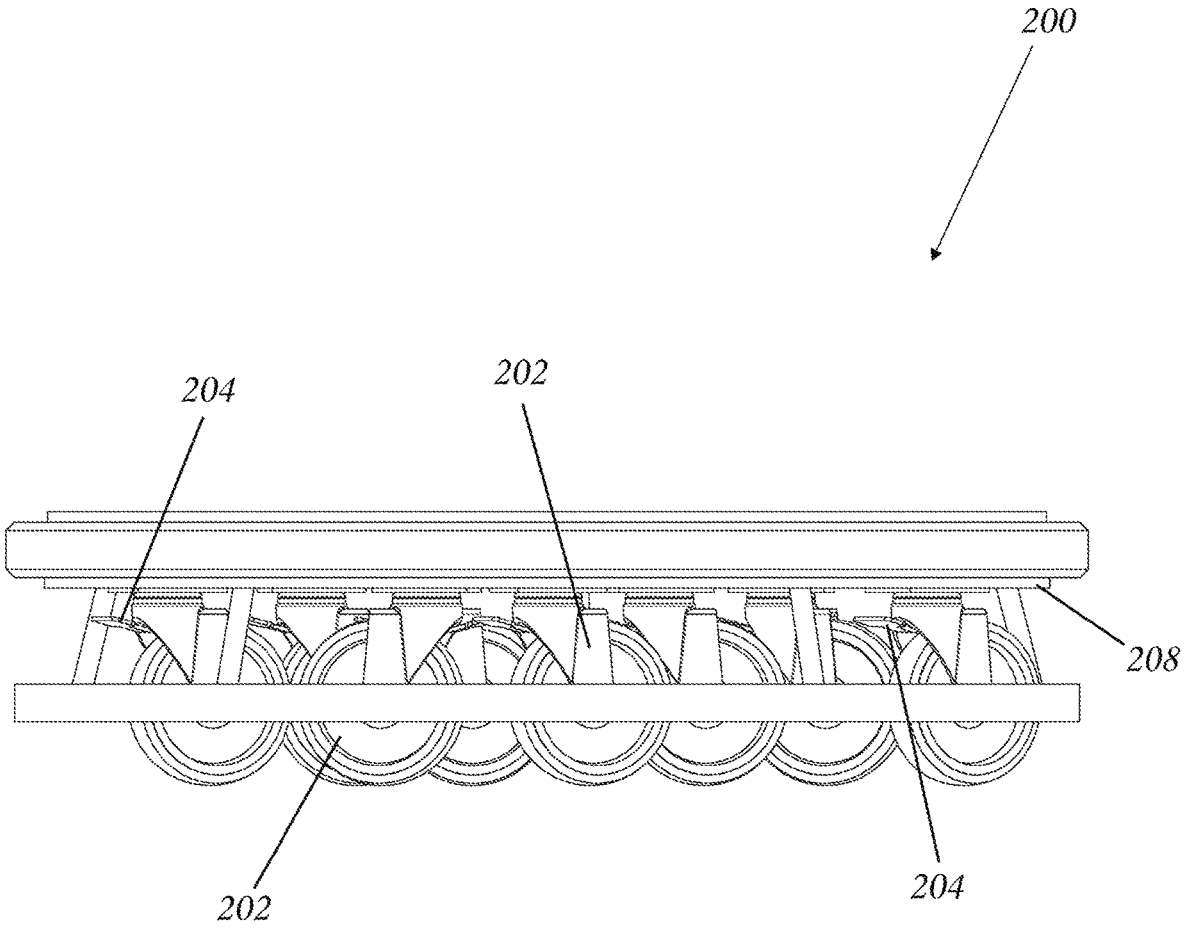
FIG. 4 is a side view depicting the system according to embodiments of the present disclosure.

Referring now to FIG. 4, a side view of system 200 is depicted according to embodiments of the present disclosure. Contrary to the caster wheels 116 depicted in FIGS. 1-3, in one or more embodiments, the caster wheels may be swivel-type caster wheels 202. Further, the swivel-type caster wheels 202 may have braking mechanisms 204 that can be depressed or otherwise activated so as to fully stop the swivel-type caster wheels 202 from rolling. The swivel-type caster wheels 202 may be attached to a bottom cover plate 208 by welding or similar methods, without limitation thereto. In other embodiments, the swivel-type caster wheels 202 may be fastened to a bottom cover plate 208 by screwing in bolts (not shown) attached to the swivel-type caster wheels 202 to one of a plurality of registration apertures (not shown) defined by the bottom cover plate 208. Accordingly, in one or more non-limiting embodiments, the other components included in system 100 shown in FIGS. 1-3, such as top cover plate 108, base plate 102, bottom cover plate 110, and protective skirt frame 112, may also be assembled in a similar fashion and utilized in system 200 in FIG. 4, but with swivel type caster wheels 202 instead of the track ball caster wheels 116.

Figure 5:
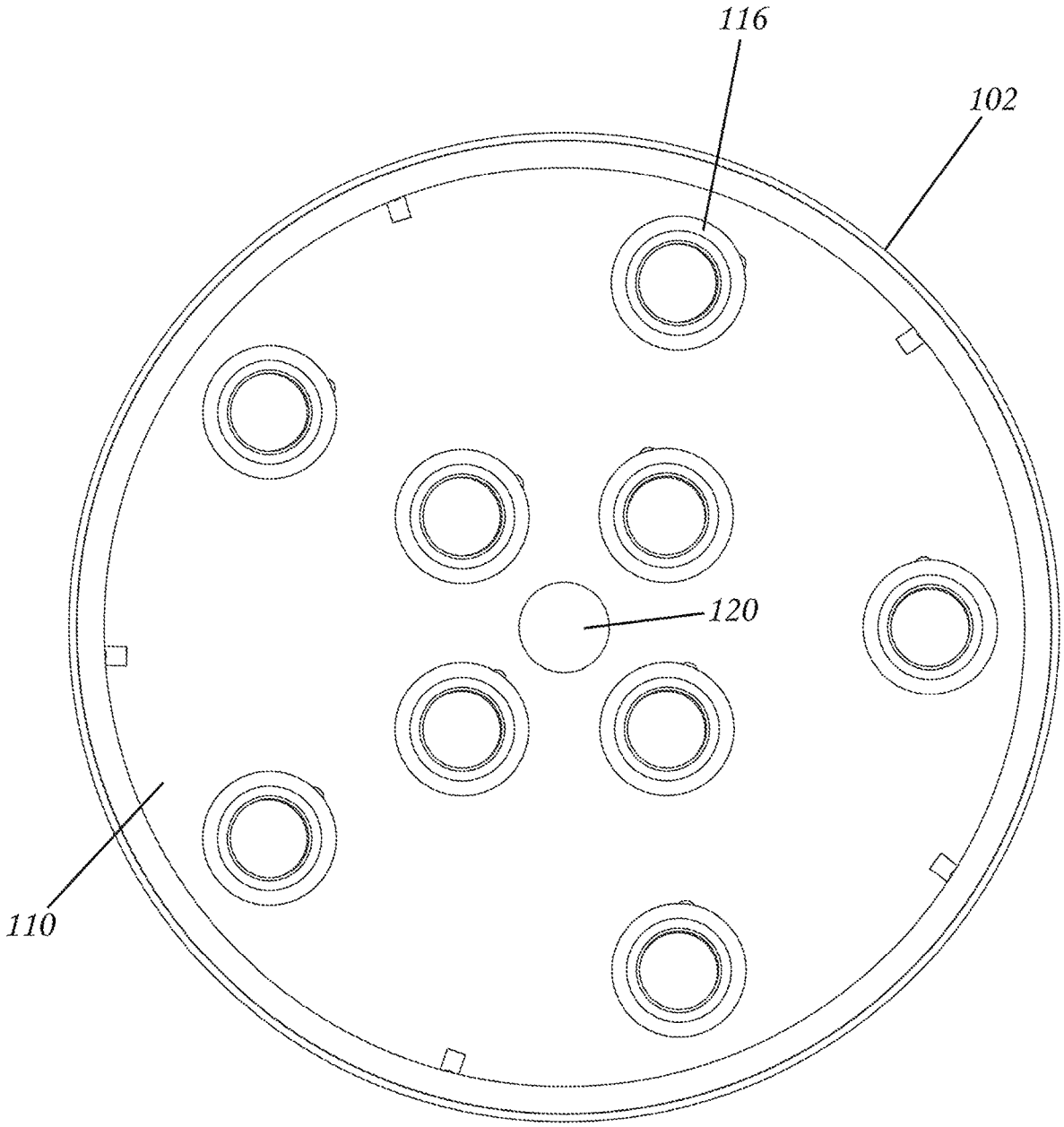
FIG. 5 is a bottom view depicting the system according to FIG. 1.

Referring now to FIG. 5, a bottom view of system 100 depicted in FIG. 1-2 and described above, is provided. In one or more embodiments, the castor wheels 116 may be fastened to the bottom cover plate 110, which may have a flat, level surface to provide uniformity and ensure smooth movement when the system is in use. In some embodiments, the caster wheels 116 may be attached to the bottom cover plate 110 by welding or similar methods. In other embodiments, the caster wheels 116 may be attached by welding or similar methods common in the art. Additionally, a skirt frame 112 may be attached to the bottom cover plate 110. The skirt frame 112 provides a barrier to protect and prevent the caster wheels 116 from making contact with different objects or walls that may be on the ground. Those of ordinary skill in the art will appreciate that more or less caster wheels 116 than those shown in FIG. 1-2 or 5 may be utilized in alternative embodiments.

Figure 6:
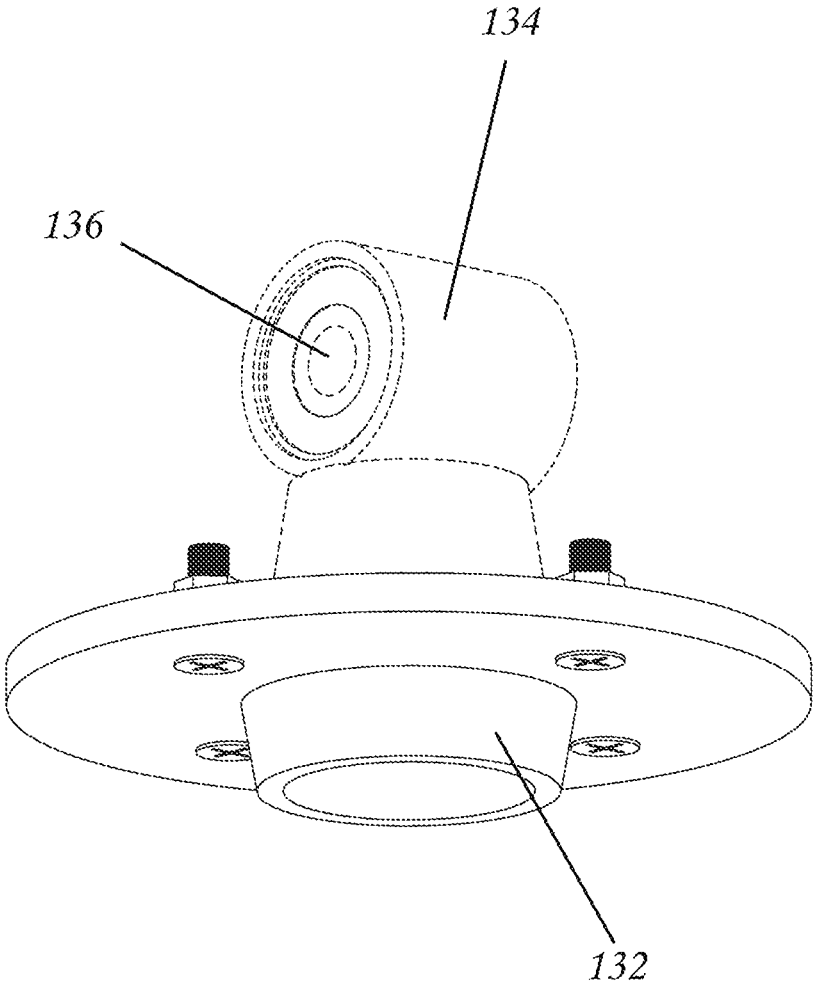
FIG. 6 is a perspective view depicting an attachment adapter base according to embodiments of the present disclosure.

Referring now to FIG. 6, a perspective view of an attachment adapter base 132 is shown according to embodiments. The attachment adapter base 132 may be configured to receive one of a plurality of attachments. For instance, a swivel connector 134 defining an aperture 136 may be fastened to adapter base plate 132 to receive one of a plurality of attachments, including modified mop or broom shafts, handles, bars, or similar items. A user can use these different attachments for other exercises that cannot readily or easily be performed without other equipment. For instance, by attaching a mop or broom shaft to the attachment adapter base 132, one can stand and perform sweeping or rowing motions for a total body workout. The base plate (not shown) having a predetermined weight and the brakes from the caster wheels (not shown) provide resistance during the sweeping or rowing motion, similar to that of rowing on a standup paddle board on a body of water.

Figure 7:
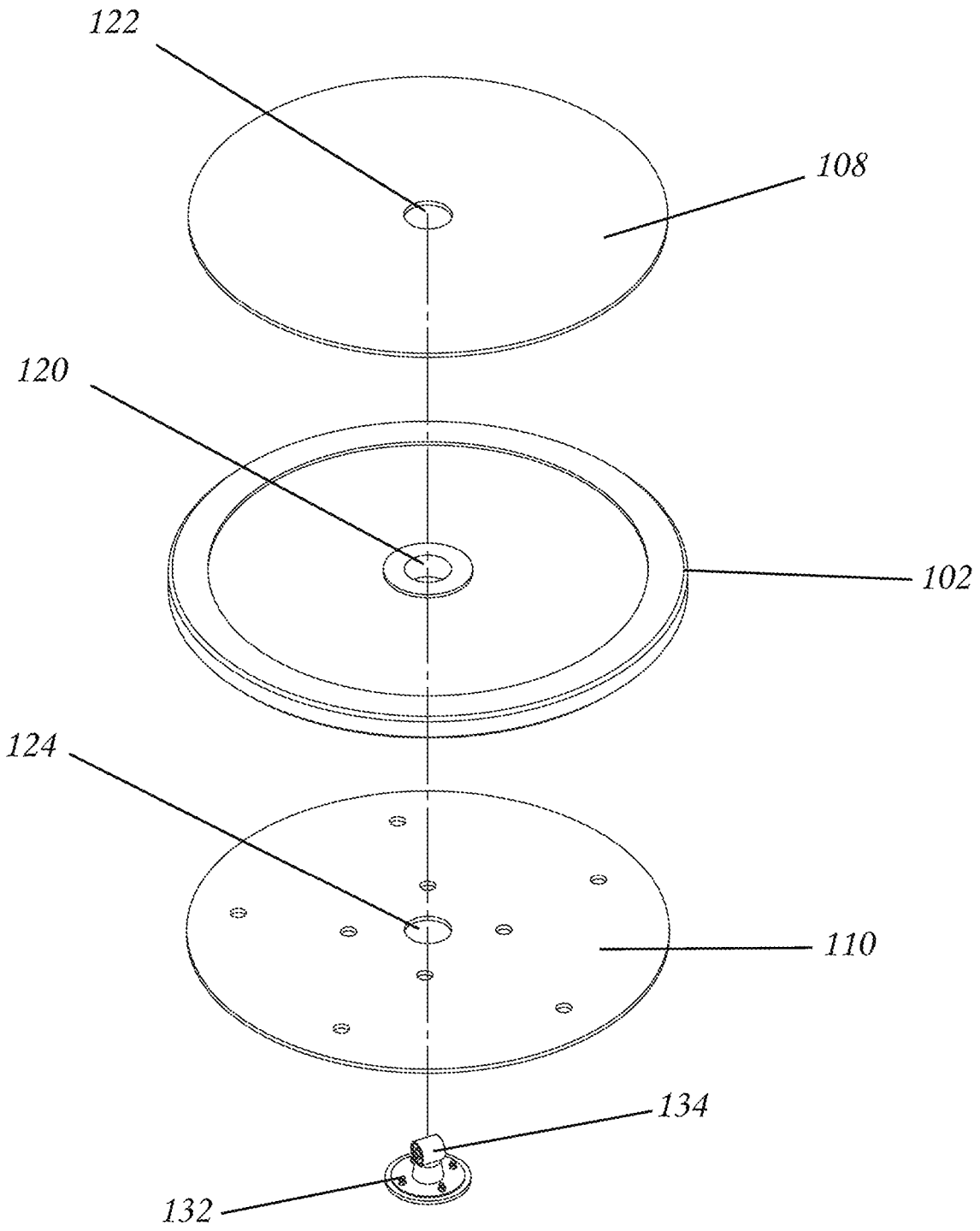
FIG. 7 is a perspective view depicting an attachment adapter base according to FIG. 6.

Referring now to FIG. 7, a perspective view of an adapter base plate, such as adapter base plate 132 is shown. As later described with respect to FIG. 8, adapter base plate 132 may be coupled to one or more components of system 100 shown in FIGS. 1-2. The system 100 may have a base plate 102 with a top face 104. A top cover plate 108 may be attached to the top face 104 of the base plate 102. The top cover plate 108 may also have a textured surface (not shown) to provide increased grip for a user and increase user stability, for instance, when a user is standing on the system 100. A skirt frame (not shown) may be attached to a bottom cover plate 110 underneath the base plate 102. A plurality of caster wheels (not shown) may also be attached to the bottom cover plate 110 underneath the base plate 102. The base plate 102 may define a central aperture 120. The bottom cover plate 110 may define a central aperture 124. The top cover plate 108 may also define a central aperture 122. The central aperture 124 of the bottom cover plate 110 and the central aperture 122 defined by the top cover plate 108 may have the same shape and size as the central aperture 120 defined by the base plate 102 such that when the top cover plate 108 and bottom cover plate 110 are attached to the base plate 102, the central apertures of all three elements are aligned to define a unified central aperture (not shown).

In one or more embodiments, the attachment adapter base 132 may be configured to have swivel connector 134 that may define an aperture 136, whereby aperture 136 is a horizontally extending bore that extends horizontally through a body of swivel connector 134. In one, non-limiting embodiment, aperture 136 may be configured to receive a pin connector 144. Various attachments can be fastened to swivel connector 134, including an extended shaft 138. In an exemplary embodiment, extended shaft 138 can have two prongs 140 that each define an aperture 142 to receive a pin connector 144. The swivel connector 134 can be inserted between the two prongs 140 of the extended shaft 138 to align the aperture 136 defined by the swivel connector 134 with each aperture 142 of the two prongs 140. Once the apertures 136 and 142 are aligned, the pin connector 144 can be inserted completely through the apertures 142 and 136 to secure and fasten the extended shaft 138 to the swivel connector 134. This attachment allows the user, for instance, to drag this exemplary embodiment of a multi-functional exercise device, also known as system 100, in a sweeping motion resembling sweeping or mopping the floor. In some embodiments, the plurality of caster wheels (not shown) may have braking mechanisms (not shown) that can be engaged to create resistance.

Figure 8:
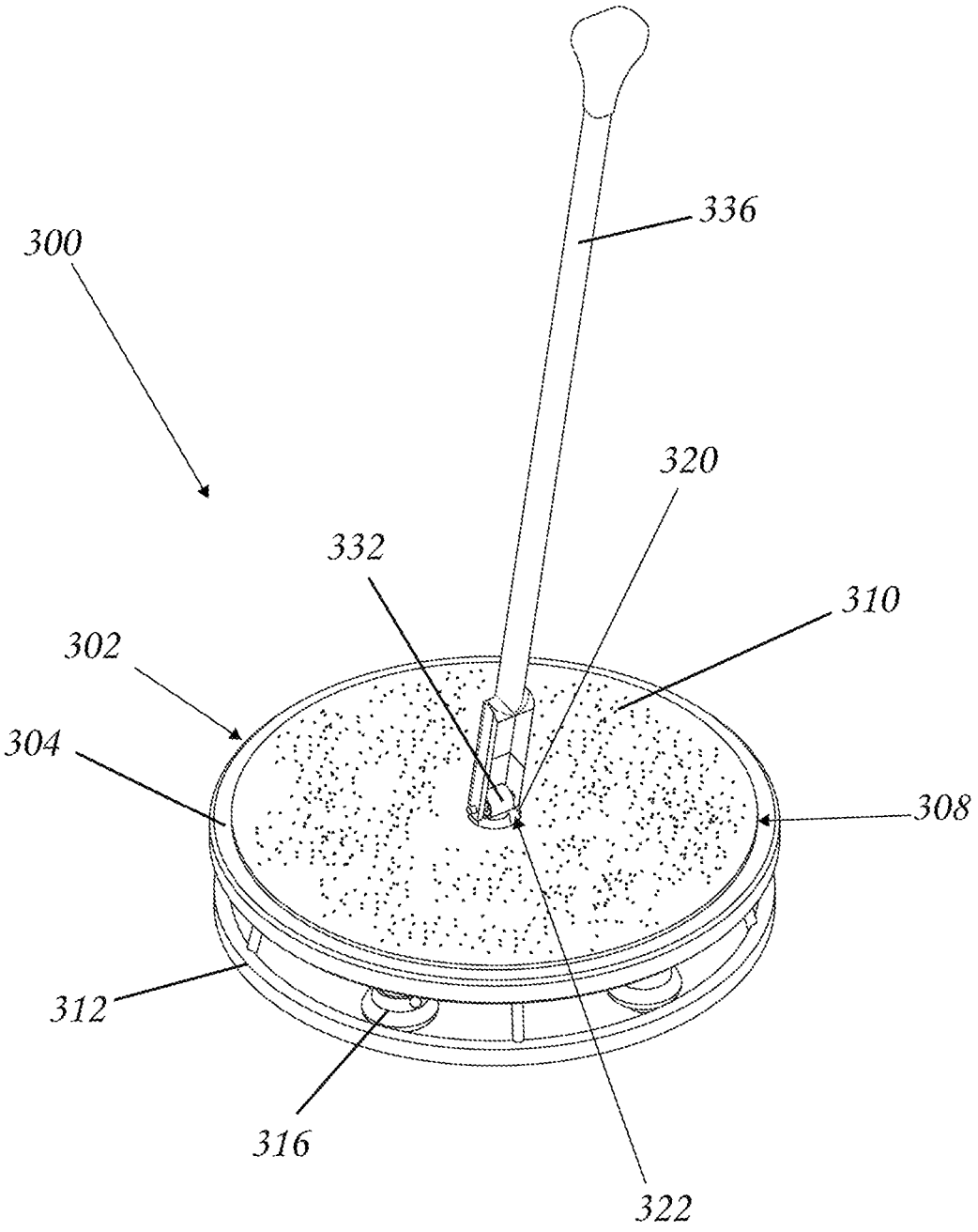
FIG. 8 is an exploded perspective view depicting an exemplary multifunctional exercise system according to embodiments of the present disclosure.

Referring now to FIG. 8, an exploded perspective view of the system 100 is depicted according to FIG. 1. The top cover plate 108 and bottom cover plate 110 can be attached to the base plate 102. The base plate may define a central aperture 120. Also, the top cover plate may define a central aperture 122 that can have the same size and shape as the central aperture 120 defined by the base plate. Further, the bottom cover plate 110 may also define a central aperture 124 that can have the same size and shape as the central aperture 120 defined by the base plate. When the top cover plate 108, base plate 102, and bottom cover plate 110 are all attached, the respective central apertures (e.g. 122, 120, and 124) may align to form a unified central aperture that extends through all of these components. An attachment adapter base 132 may be fastened to the base plate and secured within the central aperture 120 of the base plate 102. In one embodiment, the attachment adapter base 132 can be configured to include a swivel connector 134 defining an aperture (not shown). When the attachment adapter base 132 is fastened to the base plate 102, the swivel connector 134 can be pushed completely through the central apertures 120, 122, and 124 such that the swivel connector will show above the top cover plate 108.

Figure 9:
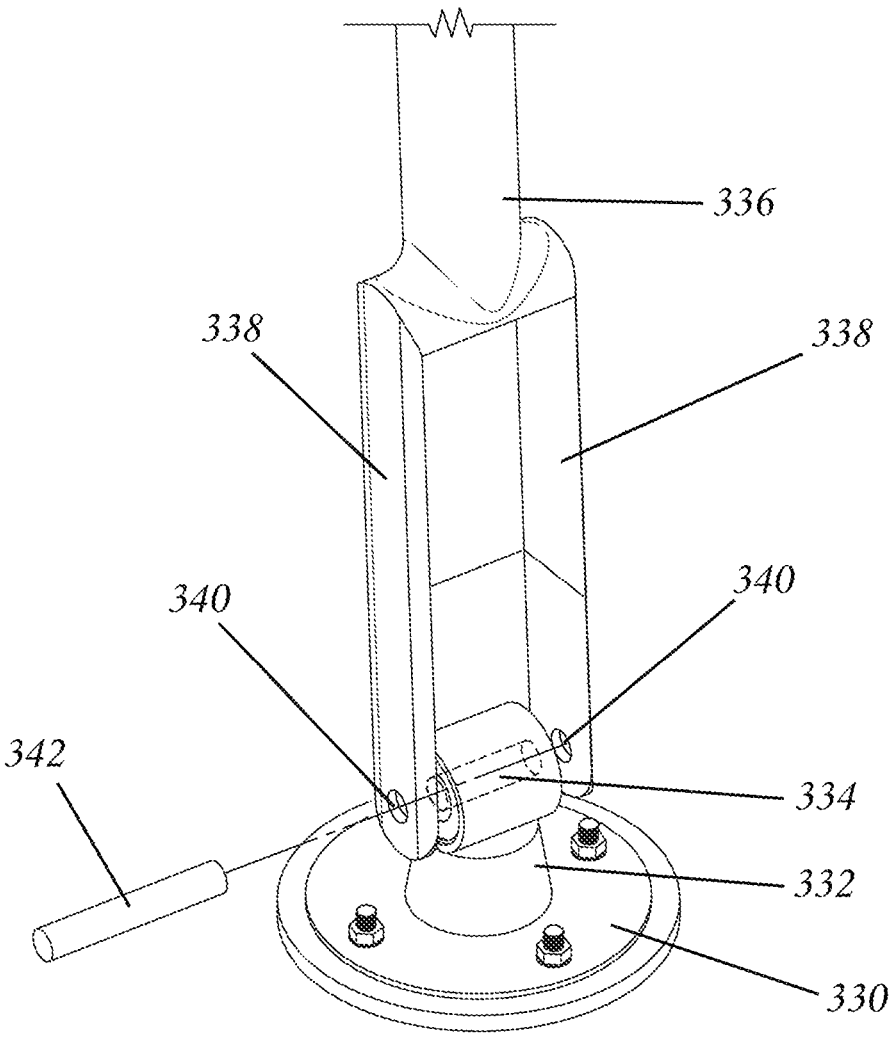
FIG. 9 is a perspective view depicting the system according to embodiments of the present disclosure.

Referring now to FIG. 9, a perspective view of the system 300 according to embodiments is shown. System 300 is a combination of the components of FIG. 1 and attachment adapter base 132 (e.g. as shown in FIGS. 6-7, including with the extendable shaft 138). In one or more embodiments, the system 300 may have a base plate 302 that may be a standard exercise plate weight. Base plate 302 may be in accordance with exercise base plate 102 as shown in FIG. 1 and described above. A top cover plate 304 may be attached to the top face (not shown) of the base plate 302. Top cover plate 304 may be in accordance with top cover plate 104. Further, the top cover plate 304 may have a textured surface 305 provide grip and stability when a standing on the system or placing different body parts to perform various exercises. A bottom cover plate (not shown) may be attached to a bottom face (not shown) of the base plate 302.

In one embodiment, once the top cover plate 304 is attached to the top face (not shown) of the base plate 302 and the bottom cover plate (e.g. in accordance with bottom cover plate 110) is attached to the bottom face (e.g. bottom face 106) of the base plate 302, the top cover plate 304, base plate 302, and bottom cover plate (e.g. bottom cover plate 110)) combined define a single central aperture 306 to receive various attachments including a swivel attachment 312. The swivel attachment 312 may be attached to an attachment adapter base, which while not visible in the assembled view shown in FIG. 9, may be an attachment adapter base in accordance with attachment adapter base 132 as shown in FIG. 6. This attachment adapter base may be fastened to the bottom cover plate (e.g. bottom cover plate 110) and further may be inserted through the single central aperture 306 to connect to attachments such as a broom/mop shaft 314. Additionally, a skirt frame 308 and omnidirectional caster wheels 310 may be attached to the bottom cover plate (not shown). Skirt frame 308 may be in accordance with skirt frame 112 described above with respect to FIG. 1, and the omnidirectional caster wheels 310 may be either track ball type caster wheels, such as caster wheels 116 shown in FIGS. 1-3, or swivel caster wheels, such as swivel type caster wheels 202 shown in FIG. 4.

Thus, FIG. 9 shows how a multi-functional exercise device and system (e.g. system 300) may be coupled to a broom/mop shaft 314 (or other extended pole adapted to be inserted into attachment adapter base 132) and to the weighted base plate. A user may hold with his or her hands the top portion of broom/mop shaft 314 and proceed to move the multi-functional exercise device and system 300 in any direction for as long as desired. Because of the resistance offered by the included base plate, the user is able to engage in a unique and effective resistance training exercise.

Figure 10:
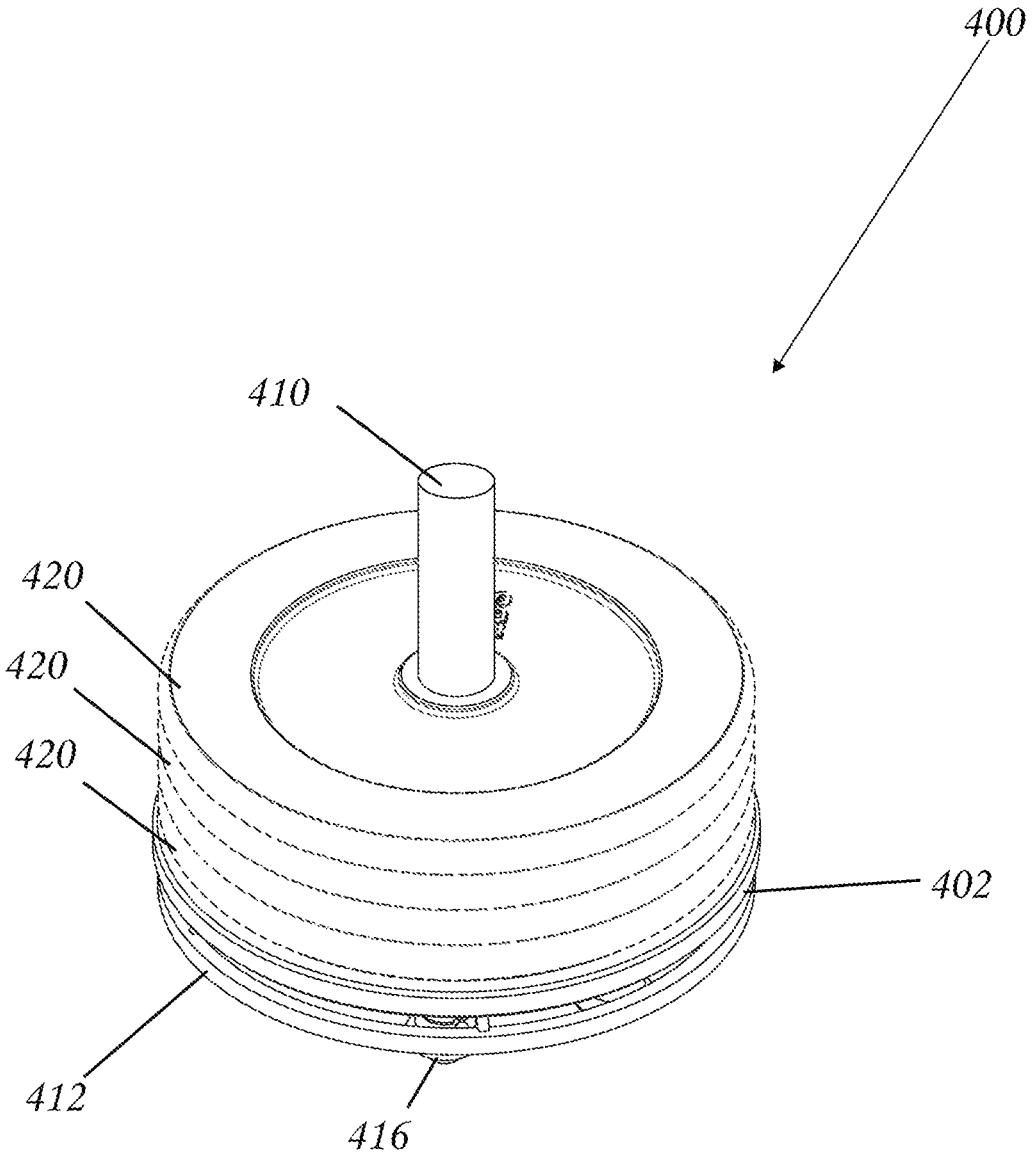
FIG. 10 is perspective view depicting the system according to embodiments of the present disclosure.

Referring now to FIG. 10, a perspective view of the system 400 according to embodiments is depicted. In one or more embodiments, a base plate 402 may be attached to a skirt frame 412 and caster wheels 416. It is noted that skirt frame 412 may be in accordance with skirt frame 112 as shown in FIG. 1 and described above. An attachment adapter base (not shown) may be fastened underneath the base plate 402 and configured to have a vertical shaft 410 that extends through a central aperture (not shown) defined by the base plate 402. This vertical shaft 410 allows the user to stack additional disks of a predetermined weight, including standard exercise plates 420. Vertical shaft 410 may be of any height desired, and such may be the height of a person to make it easier for a user to grasp the vertical shaft 410 and manipulate a position of the multi-functional exercise device and system 400. A user may stack as many standard exercise plates 420 as desired to increase resistance and intensity in an exercise. This configuration allows different exercises, including allowing a user to push or pull the system 400 similar to pushing or pulling a sled. Because of the presence of the caster wheels, such as caster wheels 416, the multi-functional device and system 400 is moveable in any direction that the user cares to direct, while the user relies on exerting effort and training his or her muscles to move the multi-functional device and system 400.

Figure 11:
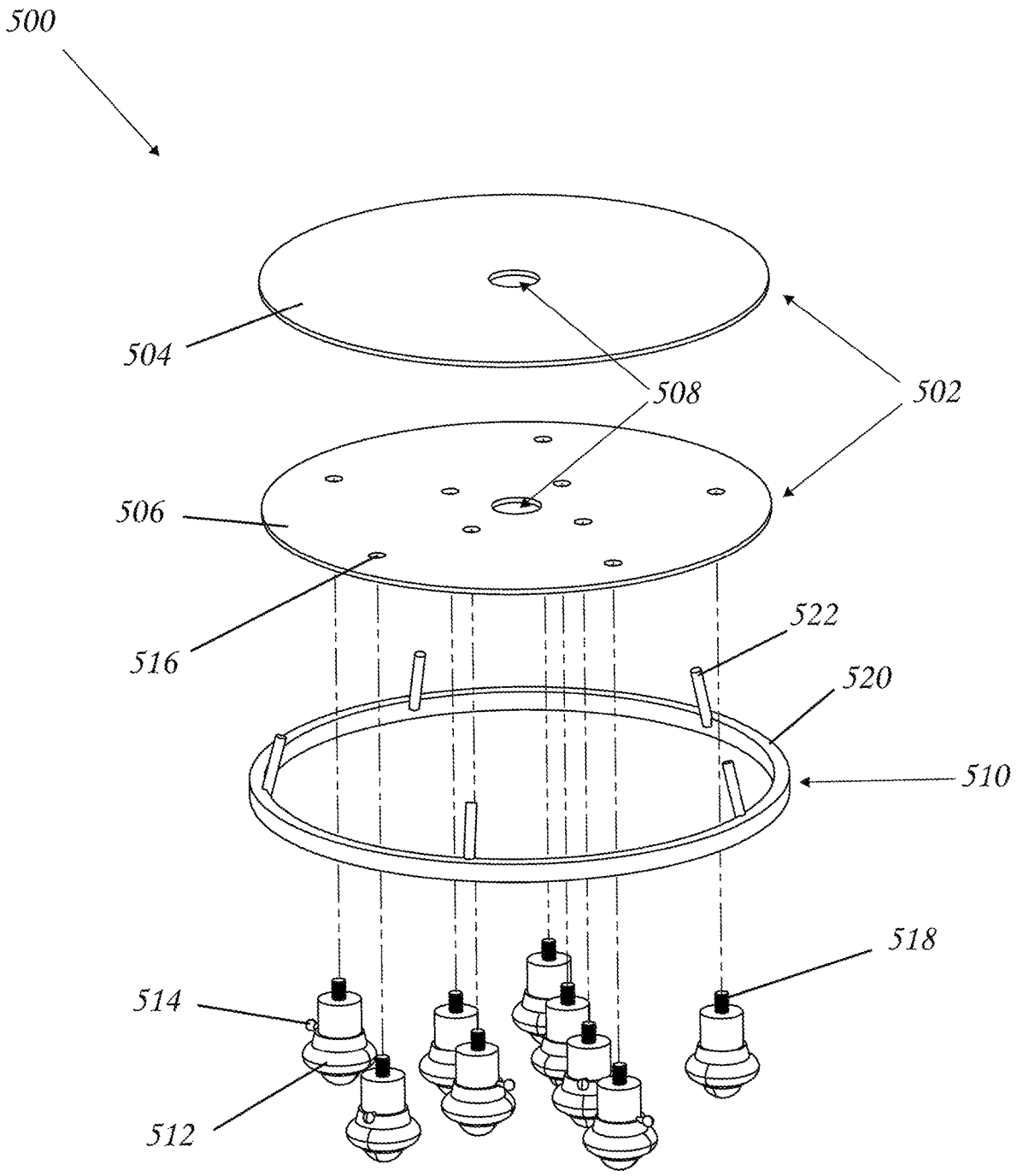
FIG. 11 is an exploded perspective view depicting the system according to embodiments of the present disclosure.

Referring now to FIG. 11, an exploded view of the system 500 is depicted according to embodiments. The system 500 may have a top plate 504 directly attached to a bottom plate 506 without plate of a predetermined weight such as a standard exercise plate weight. The top plate 504 and the bottom plate 506 combined make a base plate 502. The base plate 502 defines a unified central aperture 508. The unified central aperture 508 may have threading (not shown) to receive an attachment adapter base (not shown). The top plate 504 may have a textured top surface (not shown) to provide enhanced grip which increases stability when performing certain exercises. The system 500 may also feature a skirt frame 510 attached to the bottom plate 506. The skirt frame 510 can include a ring 520 that is similarly shaped and sized as the base plate 502. Further, the skirt frame 510 can have connecting members 522 that are circumferentially spaced on the ring 520 and extend vertically from the ring

520. The connecting members 522 can be attached to the bottom plate 506, and thus attaching the skirt frame 510 itself to the bottom plate 506 and thereby the base plate 502, by welding or similar methods. Additionally, the system 500 may have a plurality of omnidirectional wheels 512 which can be fastened to the bottom plate 506. In one embodiment, the omnidirectional wheel 512 may be ball-type caster wheels and have brakes 514. The bottom plate 506 may define a plurality of receiving apertures 516 that can receive a bolt 518 attached to an omnidirectional wheel 512. The bolt 518 may be screwed into one of the receiving apertures 516 to fasten an omnidirectional wheel 512 onto the bottom plate 506 and thus, the base plate 502.

Figure 12:
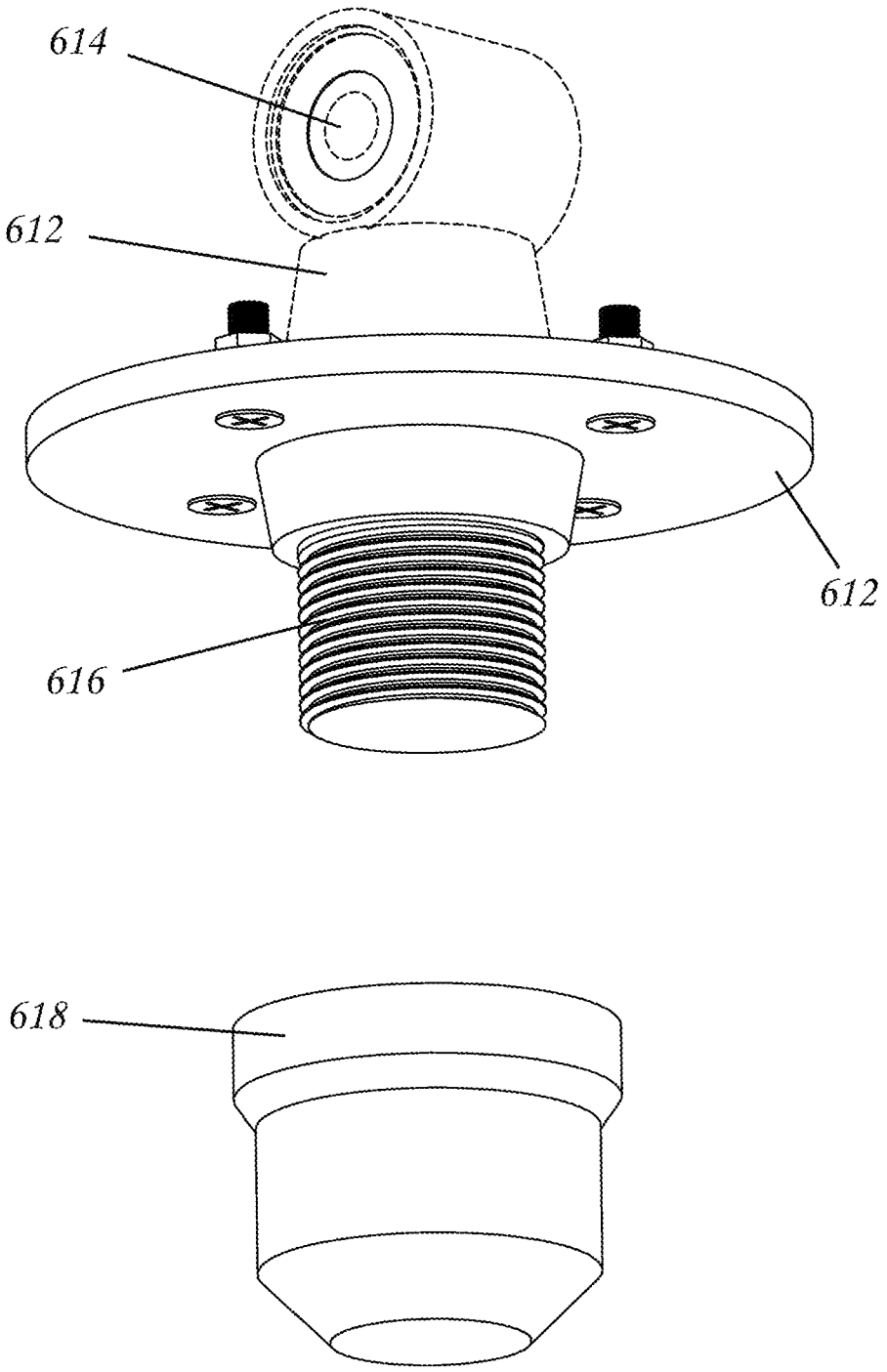
FIG. 12 is an exploded perspective view depicting an attachment adapter base according to embodiments of the present disclosure.

Referring now to FIG. 12, a perspective view of an attachment adapter base 610 is shown according to embodiments. The attachment adapter base 610 may be configured to receive one of a plurality of attachments (not shown). For instance, a swivel connector 612 defining an aperture 614 may be fastened to the attachment adapter base to receive one of a plurality of attachments (not shown), including modified mop or broom shafts, handles, bars, or similar items. The attachment adapter base 610 may also feature a threaded cylinder extension 616 that extends below the adapter base 610. Further, the attachment adapter base 610 may include a cap 618 that screws onto the threaded cylinder extension 616. The attachment adapter base 610 can be fastened onto a base plate (not shown) by fitting the threaded cylinder extension 616 through a central aperture (not shown) defined by a base plate (not shown). The threaded cylinder extension 616 can be similarly sized as the central aperture (not shown) so that only the threaded cylinder extension 616 and no other portion of the attachment adapter base 610 can fit through the central aperture (not shown). The cap 618 can then be screwed onto the threaded cylinder extension 616 to secure the attachment adapter base 610 in place. The cap 618 will prevent the attachment adapter base 610 from moving or falling out of the central aperture (not shown).

Figure 13:
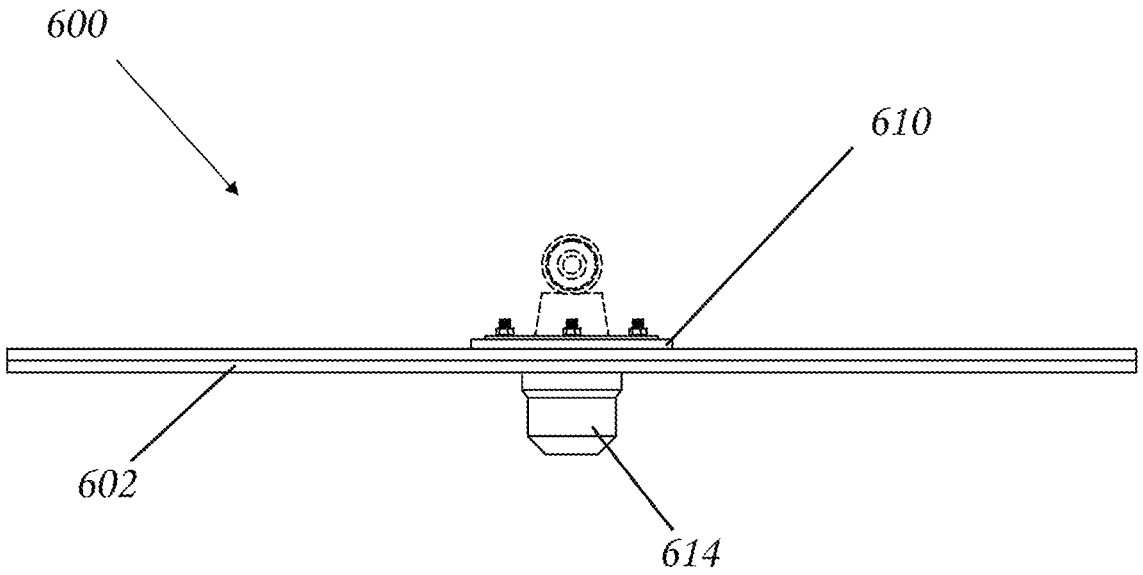
FIG. 13 is a side view depicting the system according to embodiments of the present disclosure.

Referring now to FIG. 13, a side view of the system 600 is depicted according to embodiments. The system 600 may feature a base plate 602 defining a central aperture (not shown). An attachment adapter base 610 can be fastened to the base plate 602. In one or more embodiments, the attachment adapter base 610 can be fastened to the base plate 602 by fitting a threaded cylinder extension (not shown) through the central aperture (not shown) and screwing a cap 618 onto the threaded cylinder extension (not shown) to secure the attachment adapter base 610 in place. The system 600 may have a skirt frame (not shown) attached to the base plate 602 as well as a plurality of omnidirectional wheels (not shown) attached to the base plate 602.

It is noted, therefore, that a multi-functional exercise system with variable resistance is desirable because it allows a user to perform a plurality of exercises with one system. For instance, various exercises can be performed standing or prone away from, on top of, or adjacent to the multi-functional exercise system with variable resistance herein because this system utilizes a flat disk base plate which can accommodate additional standard exercise plates as well as braking caster wheels which can also adjust the resistance. Additionally, this multi-functional exercise system with variable resistance can be used in virtually any exercise gym, accommodate a plurality of exercises, and provides variable resistance without need for resistance bands or static fixtures such as walls or pillars.

While embodiments have been illustrated and described, as noted above, many changes can be made without departing from the spirit and scope of the MULTI-FUNCTIONAL EXERCISE SYSTEM WITH VARIABLE RESISTANCE. Accordingly, the scope of the MULTI-FUNCTIONAL EXERCISE SYSTEM WITH VARIABLE RESISTANCE not limited by the disclosure of these preferred and alternate embodiments. Instead, the scope of the invention title be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A multi-functional exercise system with variable resistance, the system comprising:

a base plate comprising a top face and a bottom face, the base plate defining a central aperture that extends through the top face and the bottom face;

at least one cover plate defining a central aperture;

a plurality of omnidirectional wheels;

a protective skirt frame; and an attachment adapter base configured to receive one or more attachments;

wherein the at least one cover plate comprises a bottom cover plate;

wherein the bottom cover plate is attached to the bottom face of the base plate;

wherein the protective skirt frame is approximately the diameter of the base plate;

wherein the protective skirt frame is attached to the bottom cover plate;

wherein the attachment adapter base comprises a swivel connector.

2. The multi-functional exercise system of claim 1, further comprising a top cover plate in addition to the bottom cover plate.

3. The multi-functional exercise system of claim 2, wherein the top cover plate is fastened to the top face of the base plate.

4. The multi-functional exercise system of claim 1, wherein the base plate comprises a disk of a predetermined weight.

5. The multi-functional exercise system of claim 1, wherein the plurality of omnidirectional wheels comprise ball-type caster wheels.

6. The multi-functional exercise system of claim 1, wherein the plurality of omnidirectional wheels comprise swivel-type caster wheels.

7. The multi-functional exercise system of claim 1, wherein at least one of the plurality of omnidirectional wheels comprise brakes.

8. The multi-functional exercise system of claim 1, wherein the at least one cover plate is made of plastic.

9. The multi-functional exercise system of claim 1, wherein the at least one cover plate is made of metal.

10. The multi-functional exercise system of claim 1, wherein the plurality of omnidirectional wheels comprise adjustable brakes that have a different braking levels ranging from free rolling to full stop.

11. The multi-functional exercise system of claim 1, wherein the attachment adapter base is configured to receive a plurality of attachment adapters to receive the one or more attachments.

12. The multi-functional exercise system of claim 1, wherein the one or more attachments include a shaft, a pole, or a mop.

13. The multi-functional exercise system of claim 1, wherein the plurality of omnidirectional wheels are fastenable to the bottom cover plate, wherein the bottom cover plate defines a plurality of apertures to receive the plurality of omnidirectional wheels.

14. A multi-functional exercise system with variable resistance, the system comprising:

a base plate comprising a top cover plate and a bottom cover plate;

a plurality of omnidirectional wheels;

a protective skirt frame;

a plurality of attachments; and an attachment adapter base configured to receive at least one of the plurality of attachments;

wherein the top cover plate is attachable to the bottom cover plate;

wherein the base plate defines a one or more central apertures that extend through the top cover plate and the bottom cover plate;

wherein the bottom cover plate is configured to be coupled to a bottom face of the base plate;

wherein the protective skirt frame is approximately the diameter of the base plate;

wherein the protective skirt frame is attached to the bottom cover plate;

wherein the attachment adapter base comprises a swivel connector.

15. The system of claim 14, wherein the plurality of omnidirectional wheels comprise ball-type caster wheels.

16. The system of claim 14, wherein at least one of the plurality of omnidirectional wheels comprise brakes.

17. The system of claim 14, wherein the plurality of omnidirectional wheels comprise adjustable brakes that have a different braking levels ranging from full roll to full stop.

18. The system of claim 14, wherein the attachment adapter base is configured to receive a plurality of attachment adapters to receive the plurality of attachments.

19. The system of claim 14, wherein plurality of omnidirectional wheels are fastened to the bottom cover plate, wherein the bottom cover plate defines a plurality of apertures to receive the plurality of omnidirectional wheels.

* * * * *